United States Patent [19]

Kirch et al.

[11] 4,114,546

[45] Sep. 19, 1978

[54] SEWING MACHINE WITH A WORKPIECE GUIDE MECHANISM

[75] Inventors: Otto Kirch, Mehlingen; Erich Willenbacher, Rheinstetten, both of Germany

[73] Assignee: Pfaff Industriemaschinen GmbH, Germany

[21] Appl. No.: 846,991

[22] Filed: Oct. 31, 1977

[30] Foreign Application Priority Data

Apr. 30, 1977 [DE] Fed. Rep. of Germany ..... 7713701

[51] Int. Cl.[2] ..... D05B 35/10

[52] U.S. Cl. ..... 112/153

[58] Field of Search ..... 112/153, 152, 150, 148, 112/136, 51

[56] References Cited

U.S. PATENT DOCUMENTS

| | | | |
|---|---|---|---|
| 3,794,230 | 2/1974 | Bryan et al. | 112/153 X |
| 3,875,881 | 4/1975 | Marforio | 112/153 |
| 3,905,316 | 9/1975 | Mall | 112/153 |
| 3,913,507 | 10/1975 | Pollmeier | 112/153 |
| 4,013,026 | 3/1977 | Hall | 112/153 |
| 4,019,488 | 4/1977 | Marforio | 112/153 |
| 4,075,957 | 2/1978 | Marforio | 112/153 |

*Primary Examiner*—Ronald Feldbaum
*Attorney, Agent, or Firm*—McGlew and Tuttle

[57] ABSTRACT

A sewing machine for producing edge parallel seams in workpieces of any contour, includes a sewing machine needle which is reciprocated in a stitch forming area. A workpiece ruler guide extends laterally of the stitch forming area at an angle to a line passing through the needle axis. In addition, there is a workpiece guide mechanism which includes upper and lower guide plates forming a workpiece passage space therebetween which extends alongside the ruler. The upper plate is mounted over the lower plate for upward and downward movement relative to the lower plate and it includes a pressure point for applying a braking action on the workpiece which is effective when a tension member which is engageable with a pressure spring moves in a direction to stretch the pressure spring and increase the tension acting thereon and to urge the lower plate downwardly into engagement with the workpiece. The tension member is movable in an opposite direction to a rest position to decrease the tension on the pressure spring and, at such times, a lifting spring acts on the upper plate and produces an upward lifting force thereon to lift the upper plate.

2 Claims, 1 Drawing Figure

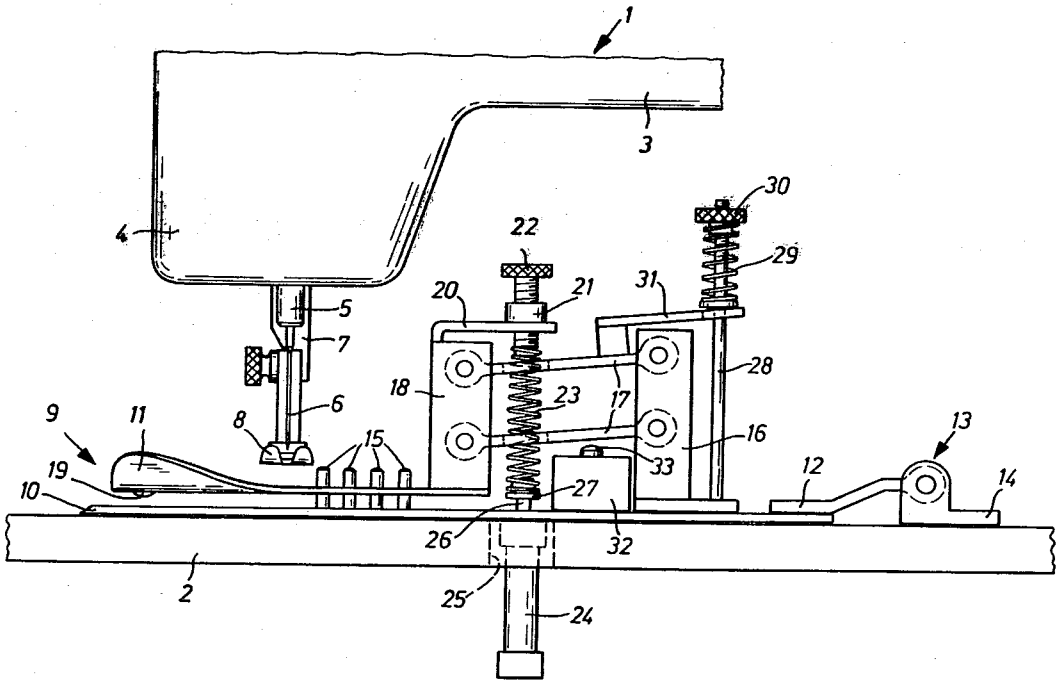
1
2
3
4
5
6
7
8
9
10
11
12
13
14
15
16
17
18
19
20
21
22
23
24
25
26
27
28
29
30
31
32
33

SEWING MACHINE WITH A WORKPIECE GUIDE MECHANISM

FIELD AND BACKGROUND OF THE INVENTION

This invention relates in general to sewing machines and, in particular, to a new and useful sewing machine for producing edge parallel seams in work plies of any contour, which is equipped with at least one feed dog, and including a guide mechanism comprising at least two plates which form a passage space and provide a pressure point, located laterally of the stitch forming area, for a work ply, and of which the upper plate is vertically movable relative to the lower plate, and which further comprises a ruler which is disposed laterally of and at an acute angle to a line passing through a needle axis in the work feed direction, and a pressure spring acting on the upper plate.

DESCRIPTION OF THE PRIOR ART

A known guide mechanism for true-to-contour registering of a work ply comprises a lower plate and an upper plate. The upper plate is mounted by means of a parallel linkage in parallel to the lower plate and is movable up and down. On the underside of the upper plate, a knoll-shaped pressure element is provided laterally of the stitch forming area. The upper plate is urged toward the lower plate by means of a pressure spring so that, during the feed motion of the work, the pressure exerts a braking force on the work, having the effect that the work ply executes a rotary motion and applies to a ruler which extends at an acute angle to a line passing in the feed direction through the needle axis.

While producing edge parallel seams in the back parts of trousers, difficulties arise in the transition area between the seat cut and the leg cut. Since the cut edges of the seat and leg cuts in the adjacent areas have both the shape of a concave arcuate line, they extend in the transition zone of the two arcuate lines, abruptly at an angle to each other. This involves a risk that the alignment torque exerted on the trouser part by the guide mechanism will cause a deformation of the cut which is fed in the zone of the transition area at an angle. In addition, because of the angular extension of the edges, the alignment effect of the guide mechanism alone is not sufficient for a true-to-contour registering of the trouser part in the transition area, and a manual guidance is required also. However, then the aligning action of the operator is hindered by the braking effect of the pressure element.

SUMMARY OF THE INVENTION

In order to overcome these disadvantages, the present invention is directed to a guide mechanism in which, during the sewing operation, the aligning effect of the mechanism can be discontinued while, at the same time, with the aligning effect suspended, the cut edge of the work ply is secured against rolling in and bending. To this end, and in accordance with the invention, a pressure spring is connected to a tension member which is movable between a working position and a rest position, and the upper plate is associated with a lifting spring which is effective as long as the tension member occupies its rest position.

By actuating the tension member cooperating with the pressure spring, the tension of the pressure spring can be completely released during the passage of the transition area of the trouser part through the guide mechanism so that the pressure spring no longer exerts any pressure on the upper plate. The lifting spring which is purposely weaker and, therefore, performs its lifting function only after the pressure spring is released, is adjusted for balancing the weight of the upper plate. Consequently, the upper plate remains in a suspended position close above the work ply, no longer producing a braking effect in the area of the pressure element and, thus, makes it possible for the operator to guide the work ply manually in an easy and unhindered manner. During this period of time, the upper plate acts as a hold-down for the work ply, thereby, preventing the cut edge thereof from rolling in or bending on the ruler of the guide mechanism.

In an advantageous embodiment of the invention, the pressure spring is designed as a tension spring and the tension member is designed as the piston rod of a compressed-air cylinder.

Accordingly, it is an object of the invention to provide a sewing machine for producing edge parallel seams in workpieces of any contour which includes a sewing machine needle which is reciprocated in a stitch forming area and which comprises a workpiece ruler guide extending laterally of the stitch forming area at an angle to a line passing through the needle axis, and which includes a workpiece guide mechanism including upper and lower guide plates forming workpiece passage space therebetween arranged alongside the ruler and wherein the upper plate is mounted over the lower plate for upward and downward movement and is engaged by a pressure spring which when it is stretched to increase the tension thereon by a tension member is effective to move the upper plate downwardly against the workpiece and apply a braking action thereto, and which also includes a lifting spring which acts on the upper plate when the tension member moves in an opposite rest direction to release the tension on the pressure spring to effect the lifting of the plate.

A further object of the invention is to provide a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is a partial side elevation of a sewing machine having a workpiece guide mechanism constructed in accordance with the invention.

DESCRIPTION OF THE PREFERRED EMBODIMENT

Referring to the drawing in particular, the invention embodied therein, comprises a sewing machine, generally designated 1, which has a needle 6 which reciprocates in a stitch forming area over a bedplate 2, through which a workpiece (not shown) is guided.

The sewing machine 1 shown in the drawing is mounted on a bedplate 2. Sewing machine 1 is indicated by a portion of the housing arm 3 and by the head 4. A needle bar 5 is mounted, in a well-known manner, for upward and downward movement on the head 4 and it carries a needle 6. A presser bar 7 with a presser foot 8, are also supported on head 4.

A guide mechanism 9 for guiding a workpiece (not shown) comprises a lower plate 10 and an upper plate 11. At the righthand end of lower plate 10, an angled hinge plate 12 of a hinge 13 is secured, with the other hinge plate 14 of the hinge being fixed to bedplate 2. A plurality of vertically extending cylindrical pins 15 are secured to the lower plate 10, and they project through corresponding apertures (not shown) provided in upper plate 11. Pins 15 form a ruler or guide for a work ply placed between the two plates 10 and 11, against which the cut edge of the work ply applies.

Lower plate 10 supports a bracket 16 on which two parallel links 17 are mounted. The links 17 have ends remote from bracket 16 which are hinged to a support 18 which carries upper plate 11. Due to the use of parallel links 17, 17, upper plate 11 can be moved upwardly and downwardly while permanently remaining in a parallel position relative to lower plate 10. A knoll-shaped pressure element 19 is secured to the underside of upper plate 11.

Support 18 has an upper end to which an angle piece 20 is secured. A nut 21 is secured to the angle piece 20 which receives a set screw 22. A tension spring 23 is secured to the lower end of the set screw 21 and it acts as a pressure spring which extends through bores of parallel links 17 and it is attached in a manner such that the set screw can turn relative to tension spring 23 but, in the axial direction, the end of tension spring 23 is firmly connected to set screw 22.

A compressed air cylinder 24 is provided on the underside of lower plate 10 and it extends through a bore 25 of bedplate 2. A flanged pin 27 to which the lower end of tension spring 23 is press-fitted is provided on the piston 26 or air cylinder 24. Air cylinder 24 does not comprise a return spring for the piston. Upon admission of compressed air, piston rod 26 is forced downwardly, whereby, the rod acts as a tension member for tension spring 23. Upon venting air cylinder 24, tension spring 23 contracts and pulls piston rod 26 upwardly.

A threaded bolt 28 is secured to lower plate 10, laterally of bracket 16, and it supports a compression spring 29 acting as a lifting spring. An adjusting nut 30 is threaded onto the bolt 28. Compression spring 29 bears against an angle piece 31 which is secured to the upper one of the parallel links 17,17. Angle piece 31 is provided with an opening (not designated) through which threaded bolt 28 extends.

A compressed air operated lifting cylinder 32 comprising a ram 33, is further provided on lower plate 10 by which, upon admission of compressed air into cylinder 32, the lower one of the parallel links 17 and, thereby, upper plate 11, are lifted to such an extent that the workpiece can easily be inserted into guide mechanism 9.

With guide mechanism 9 in an operative position, air cylinder 24 is pressurized to move piston rod 26 downwardly into its lower position, and tension spring 23 is stretched. In consequence, tension spring 23 urges upper plate 11 toward the work ply which is placed between plates 10 and 11, so that during the feed motion of the work ply, pressure element 19 produces a braking effect on the ply. Due to this braking effect, the work ply executes a rotary motion and applies against the ruler formed by pins 15. Compression spring 29 is weaker than tension spring 23, so that during this period of time, spring 29 is incapable of lifting upper plate 11.

When sewing parts of trousers, before the transition portion between the seat cut and the leg cut of a back part of the trousers passes into guide mechanism 9, air cylinder 24 is vented, whereupon, tension spring 23 instantly contracts, and piston rod 26 is pulled upwardly. As soon as tension spring 23 is thus released, the upper plate 11 is lifted slightly by the compression spring 29, so that the upper plate 11 occupies a suspended position closely above the trouser part. In this suspended position of upper plate 11, pressure element 19 can no longer produce any braking effect on the trouser part, so that it is possible for the operator to easily guide the trouser part by hand. During this period of time, upper plate 11 acts as a hold-down member, and thereby, prevents the cut edge of the trouser part from rolling in or bending on pins 15.

While a specific embodiment of the invention has been shown and described in detail to illustrate the application of the principles of the invention, it will be understood that the invention may be embodied otherwise without departing from such principles.

What is claimed is:

1. A sewing machine for producing edge parallel seams in workpieces of any contour, wherein the sewing machine includes a needle which is reciprocable in a stitch forming area, comprising a workpiece ruler guide extending laterally of the stitch forming area and at an angle to a line passing through the needle axis, a workpiece guide mechanism including upper and lower guide plates forming a workpiece passage space therebetween disposed alongside said ruler, means mounting said upper plate over said lower plate for upward and downward movement relative to said lower plate, a pressure spring having one end acting on said upper plate and having an opposite spring end, a tension member engageable with said opposite spring end, means for moving said tension member in one direction to stretch said pressure spring and increase the tension acting on said spring and to lower said upper plate against the workpiece to produce a braking effect on the workpiece, said tension member being movable in an opposite direction to a rest position to decrease the tension on said pressure spring, and a lifting spring acting on said upper plate producing an upward lifting force thereon of a magnitude to lift the said upper plate when said tension member is in a rest position and the tension on said pressure spring is reduced.

2. A sewing machine, as claimed in claim 1, wherein said pressure spring comprises a tension spring, said tension member comprising a compressed air cylinder having a piston with a rod portion engageable with said spring.

* * * * *